US005855738A

United States Patent [19]

Weisman et al.

[11] Patent Number: 5,855,738

[45] Date of Patent: Jan. 5, 1999

[54] HIGH DENSITY TISSUE AND PROCESS OF MAKING

[75] Inventors: Paul Thomas Weisman, Cincinnati; Scott Thomas Loughran, West Chester, both of Ohio

[73] Assignee: The Procter & Gamble Company, Cincinnati, Ohio

[21] Appl. No.: 766,658

[22] Filed: Dec. 16, 1996

Related U.S. Application Data

[60] Continuation of Ser. No. 465,597, Jun. 5, 1995, abandoned, which is a division of Ser. No. 370,716, Jan. 10, 1995, abandoned.

[51] Int. Cl.[6] ..... D21H 11/00

[52] U.S. Cl. ..... 162/113; 162/111; 162/117

[58] Field of Search ..... 162/109, 116, 162/117, 111, 113, 205, 206

[56] References Cited

U.S. PATENT DOCUMENTS

| | | | |
|---|---|---|---|
| 1,224,650 | 5/1917 | Kitchen | 162/117 |
| 3,044,228 | 7/1962 | Peterson | 162/205 |
| 3,124,504 | 3/1964 | Mahoney et al. | 162/206 |
| 3,203,850 | 8/1965 | McCarty | 162/113 |
| 4,191,609 | 3/1980 | Trokhan | 162/113 |
| 4,300,981 | 11/1981 | Carstens | 162/109 |
| 4,528,239 | 7/1985 | Trokan | 428/247 |
| 5,246,545 | 9/1993 | Arapulski et al. | 162/113 |
| 5,354,425 | 10/1994 | Mackey et al. | 162/135 |

FOREIGN PATENT DOCUMENTS

| | | |
|---|---|---|
| 0 342 646 A2 | 11/1989 | European Pat. Off. . |
| 0 616 074 A1 | 3/1993 | European Pat. Off. . |
| 0 613 979 A1 | 9/1994 | European Pat. Off. . |
| 0 617 164 A1 | 9/1994 | European Pat. Off. . |
| 0 631 014 A1 | 12/1994 | European Pat. Off. . |
| WO 94/24366 | 10/1994 | WIPO . |
| WO 94/28239 | 12/1994 | WIPO . |

*Primary Examiner*—Brenda A. Lamb
*Attorney, Agent, or Firm*—Larry L. Huston; E. Kelly Linman; Jacobus C. Rasser

[57] ABSTRACT

A smooth, high density tissue. The tissue has a relatively low caliper, yet maintains visually discernible machine direction micropeaks at a suitable micropeak frequency.

5 Claims, 2 Drawing Sheets

HIGH DENSITY TISSUE AND PROCESS OF MAKING

This is a continuation of U.S. patent application Ser. No. 08/465,597, filed on Jun. 5, 1995, now abandoned, which is a divisional patent U.S. patent application of Ser. No. 08/370,716, filed Jan. 19, 1995, now abandoned.

FIELD OF THE INVENTION

This invention relates to tissue and more particularly to high density tissue having a soft tactile sensation.

BACKGROUND OF THE INVENTION

Tissue is well known in the art and a staple of everyday life. Tissue is commonly divided into two uses—toilet tissue and facial tissue. Both require several attributes in order to be accepted by the consumer. One of the most important attributes is softness.

Softness is a subjective evaluation of the tactile sensation the user feels when handling or using the tissue. Softness cannot be directly measured. However relative softness values can be measured in panel score units (PSU) according to he technique set forth in commonly assigned U.S. Pat. No. 5,534,525 issued Oct. 11, 1994 to Mackey et al., except that the samples are not allowed to be judged equally soft. This patent is incorporated herein by reference. Softness has been found to be related to 1) the surface topography of the tissue, 2) the flexibility of the tissue, and 3) the slip-stick coefficient of friction of the surface of the tissue.

Several attempts have been made in the art to improve softness by increasing the flexibility of the tissue. For example, commonly assigned U.S. Pat. No. 4,191,609 issued to Trokhan has proven to be a commercially successful way to increase flexibility through a bilaterally staggered arrangement of low density regions. However, it has been well recognized in the art that multi-density tissues, which provide very high and commercially successful flexibility and softness, have an inherently distinctive topography.

However, improving, and even maintaining, softness by providing a smoother surface topography has proven to be elusive. The reason for this elusiveness is the trade-off between the smoother surface topography and increased density. Typically densification increases fiber to fiber contacts, potentially causing bonding at the contact points. This negatively impacts flexibility and hence softness. This interdependent density/softness relationship has been referred to as virtually axiomatic in commonly assigned U.S. Pat. No. 4,300,981 issued Nov. 17, 1981 to Carstens. The Carstens '981 patent also discusses the PSU softness measurement and is incorporated herein by reference. This relationship is also stated in competitive European Patent Application 0 613 979 A1, published Sep. 7, 1994, as increased void volume (i.e., decreased density) correlates with improved softness. Unfortunately, this trade-off has inimical effects for tissue products sought by the consumers.

Unexpectedly, applicants have found a way to decouple the prior art relationship between density and softness. Accordingly, it is now possible to improve the surface topography of tissue without encountering the concomitant loss of softness that occurs in the prior art. Therefore, softness levels, previously unattainable at relatively high densities, are possible with the present invention. Also, unexpectedly, absorbency is maintained at the higher density. This is contrary to prior art beliefs, as illustrated by European Patent Application 0 616 074 A1, which holds lower density results in more bulky and absorbent sheets.

Further unexpectedly, it has been found necessary to utilize a multidensity substrate to make tissue according to the present invention. This is unexpected because multidensity tissue, particularly through air dried tissue, generally has a lesser density than conventionally dried tissue having a uniform density throughout. Thus, rather than using high density tissue as a starting point in the calendering process, one must utilize relatively lower density tissues as the starting point.

BRIEF DESCRIPTION OF THE DRAWINGS

All Figures are of tissue and are taken in the machine direction.

SUMMARY OF THE INVENTION

Figure 1:
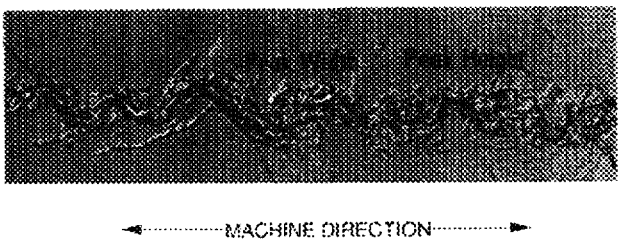
FIG. 1 is a sectional view of tissue, showing how micropeak height, micropeak width, and the number of micropeaks per inch are measured.

The invention comprises a sheet of tissue. The tissue is a macroscopically monoplanar multidensity through air dried cellulosic fibrous structure. The tissue has a smoothness with a physiological surface smoothness of less than or equal to about 600 microns, preferably less than or equal to about 550 microns, and more preferably less than or equal to about 500 microns.

The tissue may be made from a through air dried substrate. The substrate may be dried to a moisture level of about 1.9 to about 3.5 percent. The tissue may then be calendered at a pressure of about 200 to 2,000 psi, and 30 to 400 pli in the nip.

DETAILED DESCRIPTION OF THE INVENTION

The tissue according to the present invention comprises a macroscopically monoplanar cellulosic fibrous structure. The tissue is two dimensional, although not necessarily flat. By "macroscopically monoplanar" it is meant that the tissue lies principally in a single plane, recognizing that undulations in surface topographies do exist on a micro scale. The tissue, therefore, has two opposed faces. The term "cellulosic" means the tissue comprises at least 50% cellulosic fibers. The cellulosic fibers may either be hardwood or softwood, and processed as kraft, thermomechanical, stone-ground pulp, etc. all of which are well known in the art and do not comprise part of the present invention. The term "fibrous" refers to elements which are fiber-like, having one major axis with a dimension significantly greater than the other two dimensions orthogonal thereto. The term sheet refers to a macroscopically monoplanar formation of cellulosic fibers which is taken off the forming wire as a single lamina and which does not change in basis weight unless fibers are added to or removed therefrom. It is to be recognized that two, or more sheets, may be combined together—with either or both having been made according to the present invention.

The tissue of the present invention is through air dried, and may be made according to either of commonly assigned U.S. Pat. Nos. 4,191,609 issued Mar. 4, 1980 to Trokhan; 4,637,859 issued Jan. 20, 1987 to Trokhan; or 5,334,289 issued Aug. 2, 1994 issued to Trokhan et al.—all of which patents are incorporated herein by reference. Through air drying according to the aforementioned patents produces a multidensity tissue. Multidensity, through air dried tissues generally have a lesser density than tissues conventionally dried using a press felt and comprising a single region of one density. Particularly, a multidensity tissue made according to the three aforementioned patents comprises two regions, a high density region and discrete protuberances. The protuberances are of particularly low density relative to the balance of the tissue. The high density regions may comprise discrete regions juxtaposed with the low density regions or may comprise an essentially continuous network.

The tissue preferably, but not necessarily, is layered according to commonly assigned U.S. Pat. No. 3,994,771 issued to Morgan et al., which patent is incorporated herein by reference.

The tissue according to the present invention has a smoothness with a physiological surface smoothness (PSS) of less than or equal to 600 microns, preferably less than or equal to 550 microns and more preferably less than or equal to 500 microns. The physiological surface smoothness is measured according to the procedure set forth in the 1991 International Paper Physics Conference, TAPPI Book 1, more particularly the article entitled "Methods for the Measurement of the Mechanical Properties of Tissue Paper" by Ampulski et al and found at page 19. The specific procedure used is set forth at page 22, entitled "Physiological Surface Smoothness." However, the PSS value obtained by the method set forth in this article are multiplied by 1,000, to account for the conversion from millimeters to microns. This article is incorporated herein by reference for the purpose of showing how to make smoothness measurements of tissue made according to the present invention. Physiological surface smoothness is also described in commonly assigned U.S. Pat. Nos. 4,959,125 issued Sep. 25, 1990 to Spendel and 5,059,282 issued Oct. 22, 1991 to Ampulski et al., which patents are incorporated herein by reference.

For the smoothness measurement, a sample of the tissue is selected. The sample is selected to avoid wrinkles, tears, perforations, or gross deviations from macroscopic monoplanarity. The sample is conditioned at 71 to 75 degrees F. and 48 to 52 percent relative humidity for at least two hours. The sample is placed on a motorized table, and magnetically secured in place. The only deviation from the aforementioned procedure is that sixteen traces (eight forward, eight reverse) per sample are utilized, rather than the twenty traces set forth in the aforementioned article. Each forward and reverse trace is transversely offset from the adjacent forward and reverse trace about one millimeter. All sixteen traces are averaged from the same sample to yield the smoothness value for that sample.

Either face of the tissue may be selected for the smoothness measurement, provided all traces are taken from the same face. If either face of the tissue meets any of the smoothness criteria set forth herein, the entire sample of the tissue is deemed to fall within that criterion. Preferably both faces of the tissue meet the above criteria.

The tissue according to the present invention preferably has a relatively low caliper. Caliper is measured according to the following procedure, without considering the microdeviations from absolute planarity inherent to the multidensity tissues made according to the aforementioned incorporated patents.

The tissue paper is preconditioned at 71° to 75° F. and 48 to 52 percent relative humidity for two hours prior to the caliper measurement. If the caliper of toilet tissue is being measured, 15 to 20 sheets are first removed and discarded. If the caliper of facial tissue is being measured, the sample is taken from near the center of the package. The sample is selected and then conditioned for an additional 15 minutes.

Caliper is measured using a low load Thwing-Albert micrometer, Model 89-11, available from the Thwing-Albert Instrument Company of Philadelphia, Pa. The micrometer loads the sample with a pressure of 95 grams per square inch using a 2.0 inch diameter presser foot and a 2.5 inch diameter support anvil. The micrometer has a measurement capability range of 0 to 0.0400 inches. Decorated regions, perforations, edge effects, etc., of the tissue should be avoided if possible.

The caliper of tissue according to the present invention is preferably less than or equal to about 8.0 mils, more preferably less than or equal about 7.5 mils, and still more preferably less than or equal to about 7.0 mils. One skilled in the art will understand a mil is equivalent to 0.001 inches.

The tissue according to the present invention preferably has a basis weight of about 7 to about 35 pounds per 3,000 square feet. Basis weight is measured according to the following procedure.

The tissue sample is selected as described above, and conditioned at 71° to 75° F. and 48 to 52 percent relative humidity for a minimum of 2 hours. A stack of six sheets of tissue is placed on top of a cutting die. The die is square, having dimensions of 3.5 inches by 3.5 inches and may have soft polyurethane rubber within the square to ease removal of the sample from the die after cutting. The six sheets are cut using the die, and a suitable pressure plate cutter, such as a Thwing-Albert Alfa Hydraulic Pressure Sample Cutter, Model 240-10. A second set of six sheets is also cut this way. The two six-sheet stacks are then combined into a 12 sheet stack and conditioned for at least 15 additional minutes at 71° to 75° F. and 48 to 52 percent humidity.

The 12 ply samples are then weighed on a calibrated analytical balance having a resolution of at least 0.0001 grams. The balance is maintained in the same room in which the samples were conditioned. A suitable balance is made by Sartorius Instrument Company, Model A200S.

The basis weight, in units of pounds per 3,000 square feet, is calculated according to the following equation:

$$\frac{\text{Weight of 12 ply sample (grams)} \times 3000}{(453.6\ \text{grams/pound}) \times (12\ \text{plies}) \times (12.25\ \text{sq. in per ply}/144\ \text{sq. in/sq. ft.})}$$

The basis weight in units of pounds per 3,000 square feet for this 12 ply sample is more simply calculated using the following conversion equation:

$$\text{Basis Weight (lb/3,000 ft}^2) = \text{Weight of 12 ply pad (g)} \times 6.48$$

The units of density used here are grams per cubic centimeter (g/cc). With these density units of g/cc, it may be convenient to also express the basis weight in units of grams per square centimeters. The following equation may be used to make this conversion:

$$\text{Basis Weight (g/cm2)} = \frac{\text{Weight of 12 ply pad (g)}}{948.4}$$

The tissue according to the present invention preferably has a relatively high density. The density of the tissue is calculated by dividing its basis weight by its caliper. Thus, density is measured on a macro-scale, considering the tissue sample as a whole, and without regard to the differences in densities between individual regions of the paper.

The tissue according to the present invention preferably has a density of at least about 0.130 grams per cubic centimeter, preferably at least about 0.140 grams per cubic centimeter, more preferably at least about 0.150 grams per cubic centimeter, and still more preferably at least about 0.160 grams per cubic centimeter.

The tissue according to the present invention preferably has micropeaks occurring in the machine direction. A plurality of these micropeaks have a micropeak height of at least about 0.05 millimeters, preferably at least about 0.10 millimeters and more preferably at least about 0.12 millimeters. Micropeak height is illustrated in FIG. 1 as the amplitude of the tissue taken normal to the base plane of the tissue. Micropeak height is measured as the distance from the base plane of the tissue to the top of the micropeak of the tissue. The measurements are made from digitized images, as described herein. Micropeak height is taken as the mean of 12 micropeak height measurements per sample.

Micropeak width is orthogonal to micropeak height and represents the lateral extent of the micropeak in the machine direction, as illustrated in FIG. 1. Micropeak width is measured at an elevation of coincident one-half of the micropeak height as the machine direction distance from the left outside edge of the micropeak to the right outside edge of the micropeak. The measurements are made from digitized images, as described herein. Micropeak width is taken as the mean of 15 micropeak width measurements per sample.

The tissue according to the present invention preferably has a micropeak frequency of about 30 to about 60 micropeaks per inch. Micropeak frequency is measured from digitized images. A digitized cross sectional image of about 40× is provided of the tissue. Typically, the image covers about 2.0 to 2.8 millimeters of machine direction tissue. A line is drawn on the digitized image coincident the mid-elevation, left outside edge of the left-hand micropeak in the image. The line is extended horizontally to the right to the same point on the right hand peak in the image. The length of this line is measured, using image analysis software, and the number of full peaks occurring on this fine are counted. The micropeak count per millimeter is obtained by dividing the integer number of micropeaks by the length of the digitized region. This procedure is repeated until five different tissue regions of the sample are measured this way. A micropeak per millimeter value is obtained for each region and the five values are averaged. This value is converted to micropeaks per inch by multiplying by 25.4. This value, in micropeaks per inch is the micropeak frequency for that sample. If the five part average has the specified micropeak frequency, the entire tissue is judged to meet the specified micropeak frequency.

Micropeak height, micropeak width, and micropeak frequency are an artifact of the creping and through air drying processes, rather than being caused by or due to any embossing process. Micropeak height, micropeak width, and micropeak frequency are measured according to the following procedure.

The sample to be measured is stapled to a rigid frame measuring about 1.25 inches×2.125 inches on the outside, and having a central cut out measuring 0.75 inches by 1.5 inches. The frame may be made from a common manila folder, as is sold by the Smead Corp. Hastings, Minn. The sample and frame are embedded in resin. MEH100 polymeric resin, available from the Hercules Company of Wilmington, Del. has been found to work well. After the resin is cured, the sample is cross sectioned using a sliding knife microtome, so that the machine direction is viewed, as illustrated in FIG. 1. Care must be taken that the microtome intercepts the maximum height and width of the micropeak to be studied. A model 860 microtome available from the American Optical Company of Buffalo, N.Y. has been found to work well.

The cross sectioned samples of the tissue are then viewed on a Nikon stereomicroscope and digitized using JVC TK-885U CCD, or similar, camera, available from JVC Professional Products of Elmwood Park, N.J. and a Data Translation Quick Capture Frame grabber Board, made by Data Translation, Inc. of Marlboro, Mass. The measurements are then made as described above using the Optimas Image Analysis software, available from Bioscan, Inc. of Edmunds, Wash. and a 0.01 millimeter increment slide micrometer.

Figure 2:
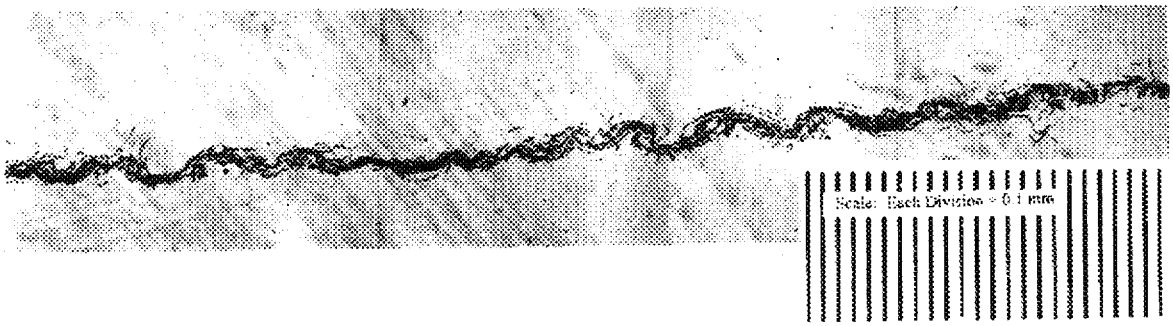
FIG. 2 is an optical microscope photomicrograph of through air dried tissue according to the prior an having 20% crepe.

As illustrated by FIG. 2, creped tissue according to the prior art shows a pattern of visually discernible micropeaks. This sample had approximately 20% crepe.

Figure 3:
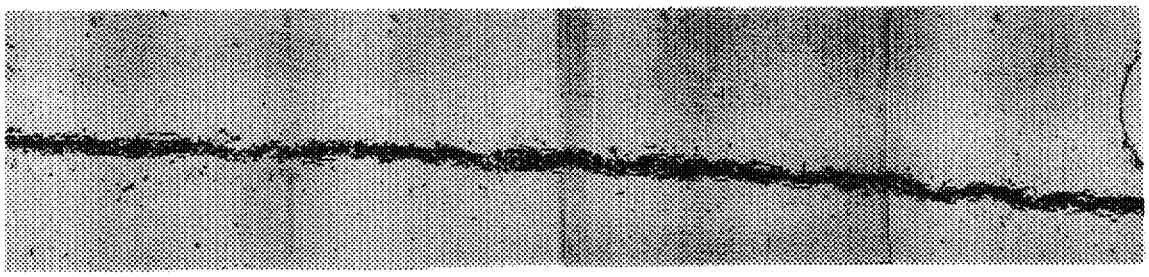
FIG. 3 is an optical microscope photomicrograph of tissue according to the present invention.

As illustrated by FIG. 3, tissue according to the present invention still retins micropeaks measurable as described above. Without being bound by theory, it is believed this topography contributes to the softness of the tissue according to the present invention. This tissue is further described in Example 3 below.

Figure 4:
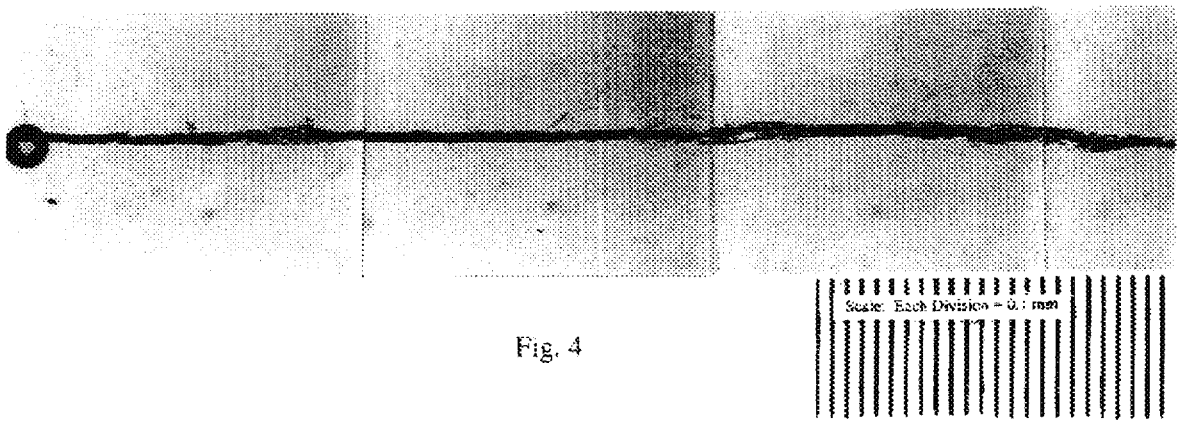
FIG. 4 is an optical microscope photomicrograph of competitive through air dried tissue which has been heavily calendered.

As illustrated by FIG. 4, a competitive through air dried tissue when calendered may have virtually no visually discernible topography.

The process for making a tissue according to the present invention comprises the following steps. First an aqueous dispersion of papermaking fibers and a foraminous forming surface, such as a Fourdrinier wire, are provided. The embryonic web is contacted with the Fourdrinier wire to form an embryonic web of papermaking fibers on the wire. Also a through air drying belt, such as is described above, is provided. The Fourdrinier wire and embryonic web are then transferred to the through air drying belt. During the transfer, a differential pressure is applied through the through air drying belt. This differential pressure deflects regions of the tissue into the belt. These deflected regions are the low density regions discussed above, and are believed to be critical to making the tissue of the present invention—despite the fact that such low density regions are later calendered to a higher density.

A heated contact drying surface, such as a Yankee drying drum, is also provided. The web of cellulosic fibers is then brought into contact with the Yankee drying drum, and preferably impressed thereagainst. This impression further increases the local difference in density between the high and low density regions of the tissue. The tissue is then dried to the desired moisture level, as set forth below, on the Yankee drying drum. Generally, the appropriate moisture level may be about 0.3 to 0.4 percent higher than moisture levels for conventional calendering operations.

The tissue is foreshortened and removed from the Yankee drying drum using a doctor blade as is well known in the art and described in commonly assigned U.S. Pat. No. 4,919,756 issued Apr. 24, 1990 to Sawdai. This patent is incorporated herein by reference. It is recognized that the angle of the doctor blade relative to the Yankee drying drum may be adjusted, and that such adjustments may affect the micropeak height and/or the micropeak frequency of the tissue.

After drying, the tissue is calendered at a mean moisture level between about 1.9 and 10.0 percent, preferably between about 1.9 and 3.5 percent, and more preferably between about 2.5 and 3.0 percent. Relatively higher moisture levels provide greater densification at generally lower caliper pressures. However, as moisture levels increase, moisture profiles on the papermaking machine are generally exaggerated. Additionally, as moisture levels increase, the sheet becomes stiffer, and hence has less softness, possibly due to hydrogen bonding, transfer of adhesive from the Yankee drying drum, etc.

Density increases of 50 to 100 percent are typical according to the calendering operation of the present invention. It is to be understood that the calendering operation increases the density of the tissue as a whole, and may or may not provide uniform percentage density increases of all regions of the multidensity tissue.

The calendering is performed using two rolls juxtaposed to form a nip between the rolls. As will be recognized by one skilled in the art, calendering may be performed using more than two rolls, with the rolls being arranged in pairs to form multiple nips. It will be further apparent to one skilled in the art that the same roll may be used in more than one pair.

The rolls may be axially parallel. However, in order to accommodate the calender pressures desirable with the present invention, one of the rolls may be crowned. The axis of the other roll may be bent so that it conforms to the crown of the first roll. Alternatively, the axes of the rolls may be slightly skewed.

Either or both of the rolls forming the nip may be steel, rubber coated, fabric coated, paper coated, etc. Either or both rolls may be maintained at a temperature optimum for roll life, i.e., to prevent overheating of the roll, or at a temperature which heats the substrate. One roll may be externally driven, the other may be frictionally driven by the first roll, so that slip is minimized.

The pairs of rolls are loaded together with a nip pressure of about 200 to 2,000 psi, and preferably with a nip pressure of about 400 to 800 psi. This loading provides a lineal nip pressure of 30 to 400 pli, and more preferably about 40 to 100 pli. One skilled in the art will recognize that the nip width can be obtained by dividing the lineal nip pressure in pli by the nip pressure in psi (pli/psi).

It is recognized that calendering the tissue according to the present invention may likely yield an increase in opacity as well. Opacity increases of about 20% are possible with the present invention.

The merits of, and techniques for making, the present invention are illustrated by the following nonlimiting examples. Each of the samples below represents a single ply, through air dried tissue. The softness measurements (in PSU) were made using Charmin brand toilet tissue, as currently marketed by The Procter & Gamble Company of Cincinnati, Ohio, as the standard.

EXAMPLE 1

Kleenex Double Roll brand toilet tissue, manufactured by the Kimberly-Clark Corporation of Dallas, Tex. was used for Example 1. The Kleenex Double Roll tissue of Example 1, was as commercially obtained, and had a caliper of 9.8 mils, and a density of grams 0.116 grams per cc. the tissue was calendered in a steel to steel nip at a pressure of 614 psi and a lineal pressure of 38 pli. The resulting tissue had a Yankee side smoothness of 584 microns and a smoothness of 614 microns on the opposite face. The density 0.197 grams per cc. While his tissue had improved smoothness, as illustrated in FIG. 4, it lacks the preferred micropeak height and frequency according to the present invention.

EXAMPLE 2

A single ply, through air dried toilet tissue according to the present invention was made on a pilot plant line. This tissue was dried on a five shed, Atlas weave fabric made according to commonly assigned U.S. Pat. No. 4,239,065 issued to Trokhan. The fabric had a warp count of 59 fibers per inch and a weft count of 44 fibers per inch. The tissue was dried to about 2.0 percent moisture on the Yankee, then immediately calendered in a rubber to steel nip at a pressure of about 95 psi and a lineal nip pressure of about 95 pli. The tissue was later calendered in a steel to steel nip at a pressure of about 600 psi and a lineal nip pressure of about 32 pli. The tissue of Example 2 had a caliper of 6.6 mils, and a density of 0.164 grams per cc. The resulting tissue had a Yankee side smoothness of 584 microns, a smoothness of 696 microns on the opposite face, and a softness of 0.5 PSU.

EXAMPLE 3

A single ply, through air dried toilet tissue according to the present invention was made on a pilot plant line. This tissue was dried on a five shed, Atlas weave fabric made according to commonly assigned U.S. Pat. No. 4,239,065 issued to Trokhan. The fabric had a warp count of 59 fibers per inch and a weft count of 44 fibers per inch. The tissue was dried to about 2.1 percent moisture on the Yankee, then immediately calendered in a rubber to steel nip at a pressure of about 10 psi and a lineal nip pressure of about 25 phi. The tissue was later calendered in a steel to rubber nip at a pressure of about 2,000 psi and a lineal nip pressure of about 310 pli. The tissue of Example 3 had a caliper of 5.8 mils, and a density of 0.159 grams per cc. The resulting tissue had a Yankee side smoothness of 534 microns, a smoothness of 490 microns on the opposite face, and a softness of 0.2 PSU. The tissue had a micropeak height of 0.14 millimeters and a micropeak frequency of 52 micropeaks per inch.

EXAMPLE 4

A single ply, through air dried toilet tissue according to the present invention was made on a pilot plant line. This tissue was dried on a five shed, Atlas weave fabric made according to commonly assigned U.S. Pat. No. 4,239,065 issued to Trokhan. The fabric had a warp count of 59 fibers per inch and a weft count of 44 fibers per inch. The tissue was dried to about 2.1 percent moisture on the Yankee, then immediately calendered in a rubber to steel nip at a pressure of about 10 psi and a lineal nip pressure of about 25 pli. The tissue was then conditioned in a high relative humidity environment until its moisture level increased to 11%. The tissue was then calendered in a steel to rubber nip at a pressure of about 2,000 psi and a lineal nip pressure of about 310 pli. The tissue of Example 4 had a caliper of 5.5 mils, and a density of 0.171 grams per cc. The resulting tissue had a Yankee side smoothness of 436 microns, a smoothness of 443 microns on the opposite face, and a softness of 0.2 PSU. The tissue had a micropeak height of 0.12 millimeters and a micropeak frequency of 45 micropeaks per inch.

The results of Examples 1 to 4 are illustrated in Table I. For completeness, Table I also provides the basis weight, density, caliper, and peak frequency of each sample.

TABLE I

| EXAMPLE NUMBER | SOFTNESS (PSU) | SMOOTHNESS YANKEE SIDE/ OPPOSITE SIDE (MICRONS) | BASIS WEIGHT (POUNDS PER 3,000 SQUARE FEET) | CALIPER (MILS) | DENSITY (GRAMS PER CC) |
|---|---|---|---|---|---|
| 1 | NA | 584/614 | 16.9 | 5.5 | 0.197 |
| 2 | 0.5 | 584/696 | 16.9 | 6.6 | 0.164 |
| 3 | 0.2 | 534/490 | 14.4 | 5.8 | 0.159 |
| 4 | 0.2 | 436/443 | 14.7 | 5.5 | 0.171 |

It will be apparent to one skilled in the art that the aforementioned parameters may be optimized as necessary. For example, it may be feasible to have a tissue of lesser smoothness, providing it has the proper density. In particular a tissue with a smoothness less than or equal to about 550 microns, and having a density of at least about 0.140 grams per cubic centimeter may be feasible. Preferably both faces of such tissue have a smoothness of less than or equal to about 550 microns, although if either face meets this criterion the tissue is made according to the present invention. The density of such tissue may preferentially be increased to 0.150 or to 0.160 grams per cubic centimeter.

The softness of one face of the tissue may be less than or equal to about 550 microns, the softness of the other face may be less than or equal to about 500 microns. More preferably, the softness of both faces of the tissue may be less than or equal to about 550 microns, and more preferably less than or equal to about 500 microns.

All such variation are within the scope of the appended claims.

What is claimed is:

1. A process of making smooth tissue paper, said process comprising the steps of:

providing an aqueous dispersion of papermaking fibers;

providing a water pervious Fourdrinier wire;

forming an embryonic web of said papermaking fibers on said wire;

providing a through air drying belt;

transferring said web to said through air drying belt, wherein a first plurality of regions of said web are dedensified upon transfer;

blowing air through said web providing a Yankee drying drum;

transferring said web from said through air drying belt to said Yankee drying drum, whereby a second plurality of regions of said web are densified upon transfer;

drying said web on said Yankee drying drum to a mean moisture level of about 1.9 to 10.0 percent to yield a multi-density tissue suitable for calendering;

providing two axially parallel rolls juxtaposed to form a nip therebetween, said nip being suitable for calendering said tissue; and calendering said tissue in said nip at said mean moisture level to provide said tissue with a smoothness less than or equal to about 600 microns and a micropeak frequency of at least about 30 micropeaks per inch.

2. The process according to claim 1 wherein said tissue has an average micropeak height of at least about 0.10 millimeters.

3. The process according to claim 1 wherein said nip provides a pressure during said calendering of said tissue of a bout 20 to 2,000 psi.

4. The process according to claim 3 wherein said nip provides a lineal pressure during said calendering of said tissue web of about 30 to 400 pli.

5. A paper according to claim 1 wherein said tissue has a micropeak frequency of about 30 to about 60 micropeaks per inch.

* * * * *